US005934924A

United States Patent [19]

Suzuki

[11] Patent Number: 5,934,924

[45] Date of Patent: Aug. 10, 1999

[54] PLUG-JACK CONNECTING STRUCTURE

[75] Inventor: Yoshiaki Suzuki, Tokyo, Japan

[73] Assignee: SMK Corporation, Tokyo, Japan

[21] Appl. No.: 08/919,345

[22] Filed: Aug. 28, 1997

[30] Foreign Application Priority Data

Aug. 28, 1996 [JP] Japan ..... 8-243985

[51] Int. Cl.[6] ..... H01R 4/54

[52] U.S. Cl. ..... 439/318; 439/668

[58] Field of Search ..... 439/312, 314, 439/318, 668

[56] References Cited

U.S. PATENT DOCUMENTS 4,180,301 12/1979 Hutter ..... 439/314

4,429,938 2/1984 Flor ..... 439/314

5,378,882 1/1995 Gong et al. ..... 439/314

*Primary Examiner*—Paula Bradley

*Assistant Examiner*—Tho D. Ta

*Attorney, Agent, or Firm*—Armstrong, Westerman, Hattori, McLeland & Naughton

[57] ABSTRACT

A plug-jack connecting structure is provided which includes a jack having a sleeve at a forward end of the jack. The sleeve has a non-circular outside shape and has grooves cut in an outer periphery thereof. A plug has a ring rotatably mounted thereon at one end thereof for receiving the sleeve. The ring has a sleeve receiving hole which has a shape complementary to the outside shape of the sleeve. By turning the ring through a 90 degree angle into engagement with the grooves, the jack and the plug are connected in a state in which they are prevented from being disengaged.

3 Claims, 4 Drawing Sheets

PLUG-JACK CONNECTING STRUCTURE

BACKGROUND OF THE INVENTION

1. Field of the Invention

The present invention relates to a structure for interconnecting a plug and jack by inserting the plug into the jack and, more particularly, to a plug-jack connecting structure for interconnecting a plug and a jack which prevents the unexpected detachment of the plug from the jack even when the plug-jack connecting structure connecting the plug to the jack is vibrated or shocked.

2. Description of the Prior Art

Electronic equipment, such as a car phone, a TV, etc., is put into an operative state when a plug of the electronic equipment is inserted into a jack mounted on the front panel of the car. The connection between the plug and the jack is usually made by elastic contact between terminals disposed along a plug receiving hole of the jack and the periphery of the plug. In other words, a plurality of terminals are mounted inside of the jack and the plurality of terminals serve as a ground terminal and as positive and negative electrode terminals.

Furthermore, the terminals are partly bent or punched to form elastic contact portions. When a multi-polar plug is inserted into the jack of such a construction as above-described, respective terminals elastically contact the corresponding electrodes of the plug to establish electric connections therewith and to firmly hold the plug in the jack. However, the forces exerted on the periphery of the plug by the elastic contact of the plug and the terminals make it highly likely that the plug will detach from the jack due to vibrations and shocks created during traveling, which often results in an interruption of telephone communication, TV reception, etc.

To overcome such a disadvantage, the plug is conventionally screwed into the jack. A conventional screw type plug-jack connecting structure includes a male screw thread which extends outwardly from the outer surface of a sleeve that guides the plug into the jack. A conventional screw type plug-jack connecting structure also includes a ring mounted on the plug at one end thereof and a female screw thread which has been extruded inwardly from the inner surface of the ring.

With such a screw type plug-jack connecting structure, the ring carried by the plug is butted end-to-end against the sleeve of the jack and then rotated into threaded engagement with the sleeve, so that the plug and the sleeve can be firmly coupled with each other. Thus, the conventional screw type plug-jack connecting structure provides the coupling between the plug and the sleeve of the jack by screwing in order to preclude the possibility of the plug accidentally becoming detached from the jack due to vibrations and shocks.

With the conventional screw type plug-jack connecting structure, however, the ring mounted on the plug needs to be frequently rotated into threaded engagement with the sleeve, thus making the connecting operation cumbersome. More particularly, in the case of connecting the plug to the sleeve during driving, the driver's attention is at least momentarily diverted from his/her driving, thus posing the danger of a traffic accident.

Another problem of the conventional screw type plug-jack connecting structure is the need for forming screw threads on both of the sleeve and the ring. The use of metal for the sleeve and the ring so that the male and female screw threads can be cut into the outer & inner surfaces thereof, respectively, inevitably increases the manufacturing cost of the conventional screw type plug-jack connecting structure. On the other hand, the formation of screw threads, during the formation of dies by molding of a resin material, would require highly developed molding techniques and complicated molding machine which involve a screw-wise transfer of one of the dies during molding. This would also raise the manufacturing cost of the conventional screw type plug-jack connecting structure.

SUMMARY OF THE INVENTION

It is therefore an object of the present invention to provide a simple-structured, easy-to-fabricate plug-jack connecting structure which permits connection between the plug and the jack through a simple manipulation even if the jack is made by molding.

According to an aspect of the present invention, a plug-jack connecting structure is provided for making connections between a plurality of terminals secured to a jack and a plurality of corresponding electrodes of a plug by inserting the plug into the jack. The plug-jack connecting structure includes a sleeve having an outside shape which is a non circular. The sleeve is formed as a unitary structure with the jack at one end thereof. The plug-jack connecting structure also includes a ring having a sleeve receiving hole. The sleeve receiving hole is of a shape complementary to that of the sleeve and the sleeve receiving hole is rotatably mounted on the plug at one end of the plug opposite the jack. The plug-jack connecting structure also includes grooves cut in the outer periphery of the sleeve along the direction of rotation of the ring so that when the ring is rotated, the inner periphery of the sleeve receiving hole comes into engagement with the grooves to prevent disengagement of the ring and the sleeve from each other.

With this structure, the grooves, cut in the outer peripheral surface of the sleeve and the inner peripheral surface of the sleeve receiving hole of the ring, are brought into engagement by the rotation of the ring to establish a connection between the plug and jack. In this state, the engagement of the inner peripheral surface of the sleeve receiving hole with the grooves on the outer peripheral surface of the sleeve serves to provide firm coupling of the plug to the jack. Moreover, since the sleeve of the jack has a non circular outside shape and since the sleeve receiving hole of the ring has a shape complementary to the outside shape of the sleeve, it is easy to position the ring and the sleeve relative to each other.

According to still another aspect of the present invention, the width of each groove and the thickness of the inner periphery of the sleeve receiving hole are substantially equal to each other. With this structure, the inner side walls of each groove and the outer surface of the ring make close contact with each other so that there is little or no play in the coupling between the jack and the plug.

According to still another aspect of the present invention, recesses are formed in the inner side walls of the grooves and protrusions are protrusively provided on the ring for engagement with the recesses at a rotational angular position where the sleeve receiving hole and the grooves engage each other. With this structure, the engagement of the protrusions of the ring with the recesses in the grooves arrests rotational motion of the ring, ensuring holding of the plug in the jack.

DESCRIPTION OF THE PREFERRED EMBODIMENT

Figure 1:
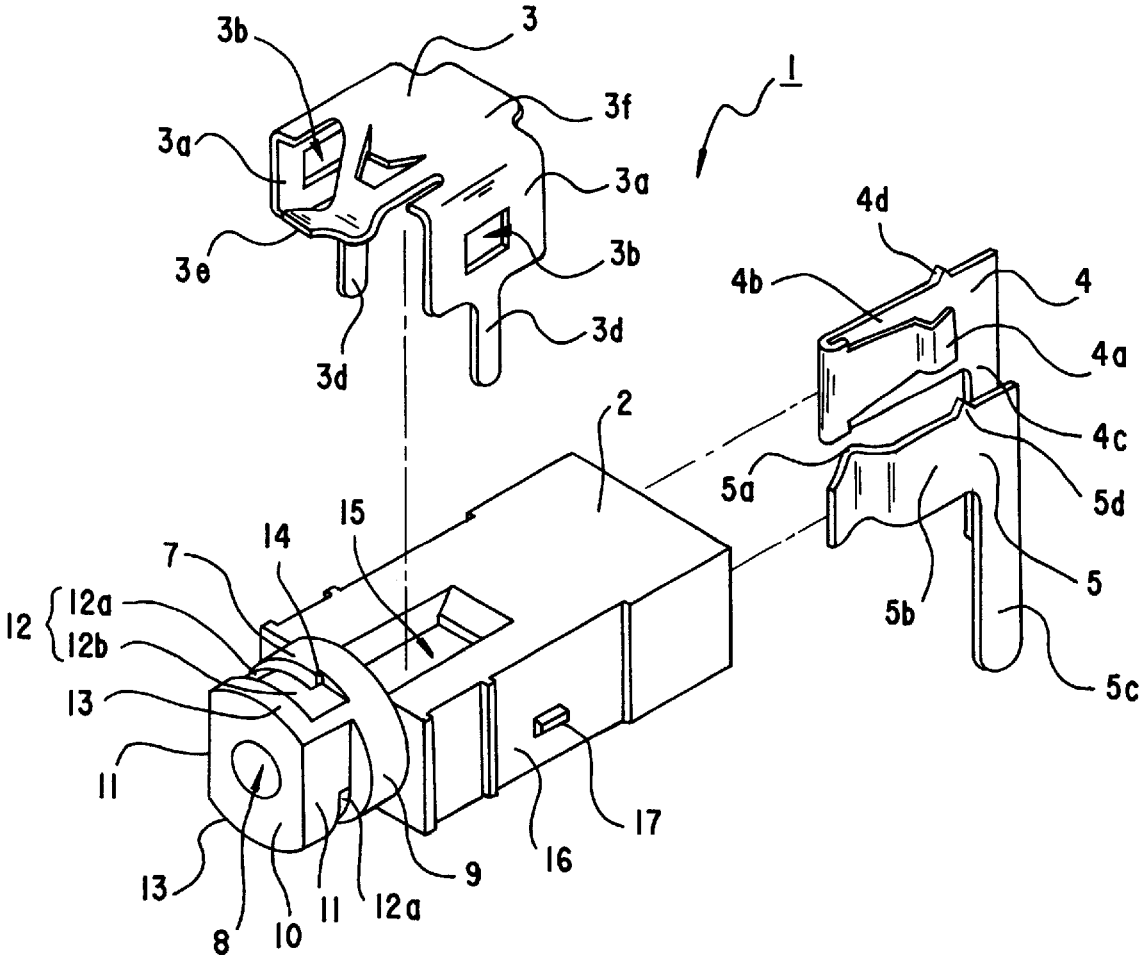
FIG. 1 is an exploded perspective view of an embodiment of a jack of the plug-jack connecting structure of the present invention.
Figure 10:
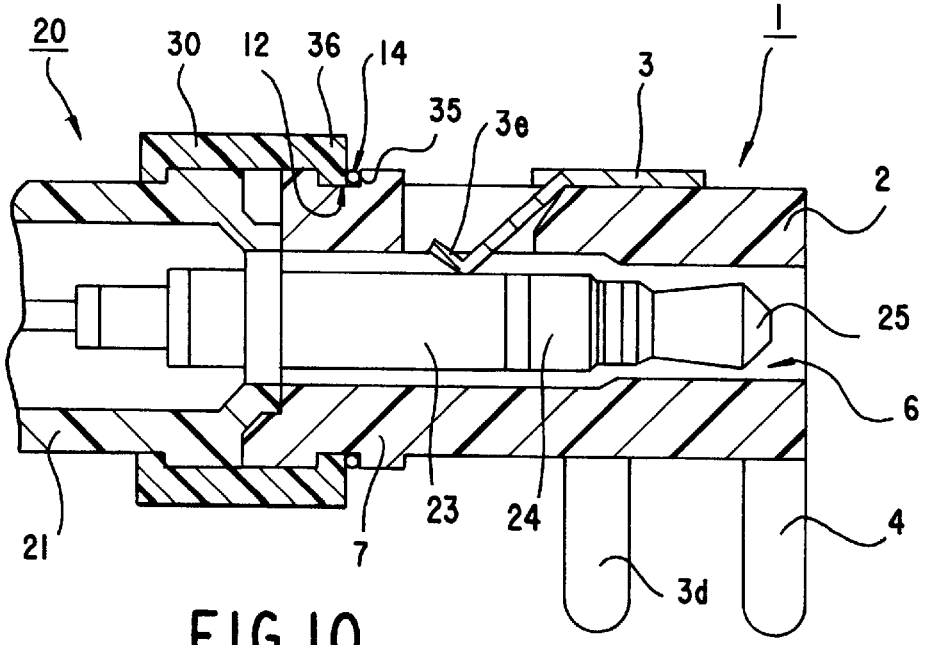
FIG. 10 is a cross-sectional view showing the connection between the jack and the plug of the plug-jack connecting structure of the present invention.

The accompanying drawings illustrate an embodiment of the present invention, wherein FIGS. 1–5 show a jack 1, FIGS. 6–9 show a plug 20, and FIG. 10 shows a state in which the plug 20 is inserted in the jack 1. The jack 1 is mounted, for example, on the front panel of a car and, as shown in FIG. 1, the jack 1 has sleeve, chip and ring terminals 3, 4 and 5 made of a conductive material and secured to a jack housing 2 to make electric connections with corresponding electrodes of the plug 20, respectively.

The jack housing 2 is substantially a box-shaped molding of an insulating synthetic resin and, as shown in FIG. 10, the jack housing 2 has a plug receiving hole 6 extending therethrough in an axial or lengthwise direction thereof. The jack housing 2 carries at a forward end, thereof, a tubular sleeve 7 formed integrally with the jack housing 2.

The tubular sleeve 7 has a plug guide hole 8 which communicates with the plug receiving hole 6. The end portion of the sleeve 7, which is contiguous to the jack housing 2, forms a base portion 9 having a circular outside shape. The base portion 9 has at a forward end thereof, a mounting portion 10 formed as a unitary structure with the base portion 9. The mounting portion 10 is composed of circular-arc portions 13, concentric with the base portion 9, and flat portions 11, formed by cutting the circular outside shape of the base portion 9, to provide the same chords at right and left sides of the circular-arc portions 13. The outer periphery of the mounting portion 10 is oval-shaped as a whole.

Referring to FIGS. 2–5, the mounting portion 10 of the sleeve 7 has a pair of grooves 12. The grooves 12 are cut into upper and lower peripheral surfaces of the mounting portion 10 along a circular arc that crosses at right angles to the axial direction of the sleeve 7. Thus, the grooves 12 extend in the direction of rotation of a ring 30 of the plug 20 (to be described in more detail below).

The grooves 12 each have a sloped portion 12*a* which extends from an intermediate portion of one of the flat portions 11 and which is concentric with the base portion 9. The grooves 12 also each have a flat engaging portion 12*b* which is contiguous to the sloped portion 12*a* at one end thereof. Thus, each flat engaging portion 12*b* lies inside one of the circular-arc portions 13. Each groove 12 has a recess 14 cut in the flat engaging portion 12*b* by forming a stepped portion in the side wall of the base portion 9 facing the engaging portion 12*b*.

Figure 6:
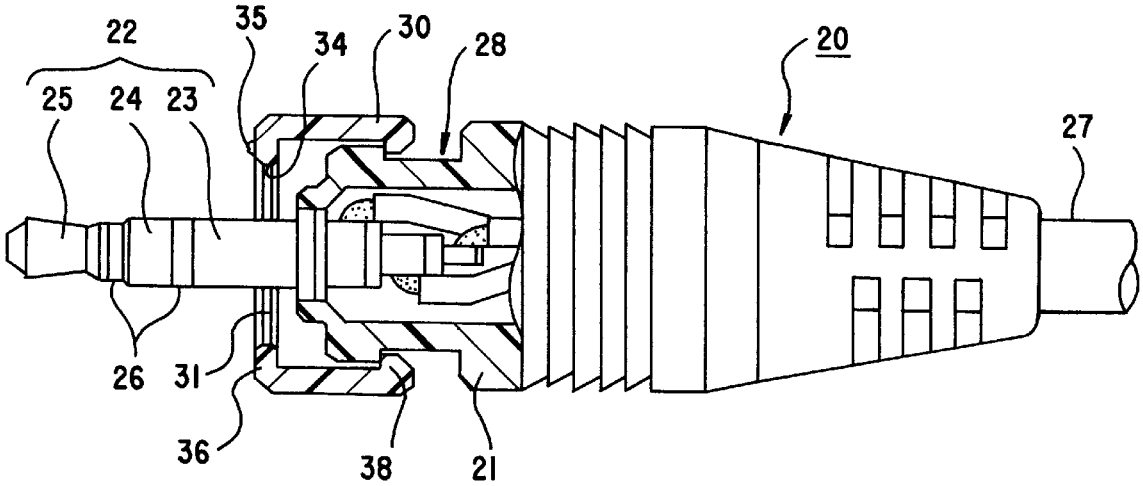
FIG. 6 is a side view, partially broken away, of a plug of the plug-jack connecting structure of the present invention to be connected with the jack of FIG. 1.

The plug 20 is connected to a connecting cord terminal of the electronic equipment, such as a car phone, TV or similar. As illustrated in FIG. 6, the plug 20 has a cover 21, made of insulating rubber or similar material, and a rod-shaped plug body 22. The rod-shaped plug body 22 extends in the axial direction of the cover 21 and has a forward end portion extending outwardly therefrom.

The plug body 22, which extends outwardly of the cover 21, forms a chip electrode 24, a ring electrode 25 and a sleeve electrode 23. The chip electrode 24, ring electrode 25, and sleeve electrode 23 are separated by insulators 26. Inside the cover 21, the plug body 22 is connected to a connection cord 27 from the equipment such as a car phone or similar.

A ring receiving groove 28 is cut in the outer surface of the forward end portion of the cover 21 so as to extend circumferentially thereof. The ring 28 receives a stopper portion 38 extending inwardly from a ring 30 at the rear end thereof so that the ring 30 is mounted on the plug 20 at the forward end thereof in a manner so as to be rotatable and movable back and forth.

The ring 30 is a tubular molding which is made of a resin, such as polyacetal or polyimide resin, that is highly slippery. The ring 30 has a front side bent inwardly, as indicated by 38 to form a sleeve receiving hole 31 into which the sleeve 7 of the jack 1 is inserted, when the plug 20 is coupled to the jack 1.

Figure 7:
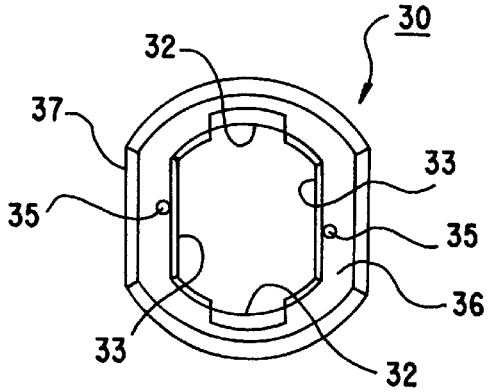
FIG. 7 is a front view of a ring of the plug-jack connecting structure.

The inner periphery 34, which defines the sleeve receiving hole 31, has upper and lower circular-arc portions 32 and flat portions 33 forming parallel chords at both sides of the circular arc portions 32, as illustrated in FIG. 7, so that the inner periphery 34 has substantially an oval configuration. Hence, the inner periphery 34 of the sleeve receiving hole 31 has a shape complementary to the outside shape of the sleeve 7 of the jack 1 to permit the insertion thereinto of the sleeve 7. The inner periphery 34 of the sleeve receiving hole 31 engages the grooves 12 of the sleeve 7 to allow the plug 20 to be coupled with the jack 1. By turning the ring 30, after the sleeve 7 has been inserted along the sleeve receiving hole 31, the sleeve 7 is locked in place.

Protrusions 35 are provided on the front surface of the ring 30. The protrusions 35 are disposed on the bent portion 36 of the ring 30 outside the sleeve receiving hole 31. The protrusions 35 are provided so as to correspond to the recesses 14 of the sleeve 7 and are fitted into the recesses 14 when the ring 30 and the sleeve 7 are coupled to each other.

Figure 2:
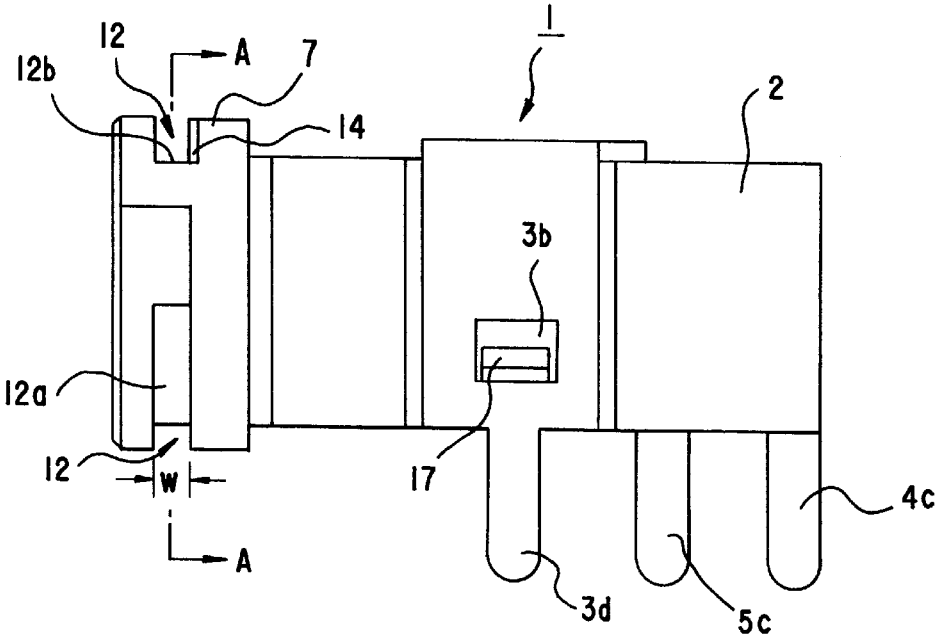
FIG. 2 is a side view of the jack of FIG. 1.
Figure 3:
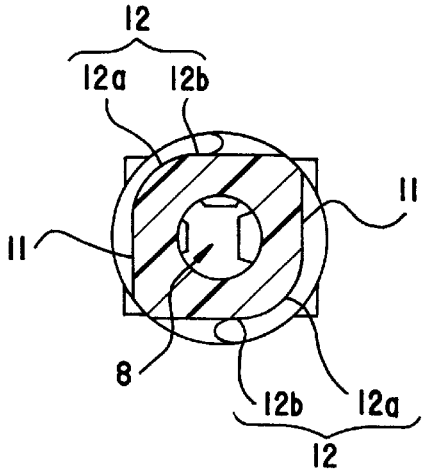
FIG. 3 is a cross-sectional view of the jack of FIG. 1 taken along line A—A in FIG. 2.
Figure 4:
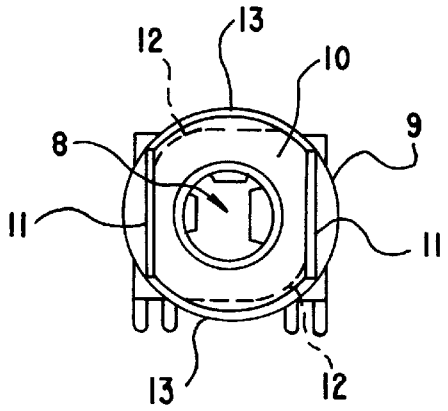
FIG. 4 is a front view of a sleeve of the plug-jack connecting structure of the present invention.
Figure 5:
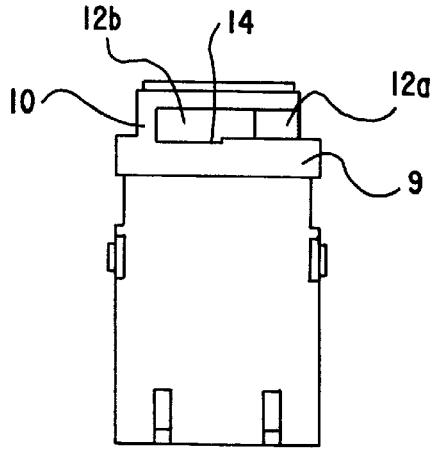
FIG. 5 is a bottom view of the jack of FIG. 1.
Figure 8:
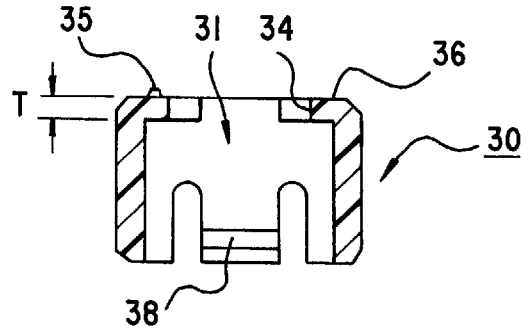
FIG. 8 is a cross-sectional view of the ring of FIG. 7.
Figure 9:
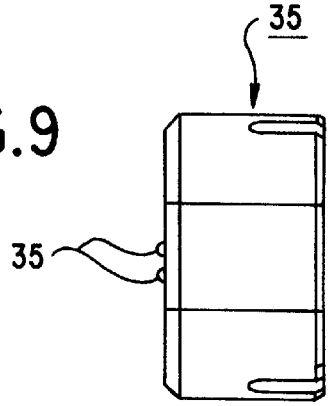
FIG. 9 is a side view of the ring of FIG. 7.

The thickness T of the inner periphery 34 of the sleeve 31 of the ring 30, as shown in FIG. 8, and the width W of the groove 12 of the sleeve 7, as shown in FIG. 2, are chosen to be about the same. For example, the thickness T is chosen exactly the same as or about 0.1 mm smaller than the width W. By such setting of the thickness T and the width W, the grooves 12 of the sleeve 7 and the inner periphery 34 of the sleeve receiving hole 31 can be held in close contact with each other, ensuring tight coupling between the sleeve 7 and the ring 30.

While in this embodiment the outside shape of the ring 30 is substantially oval, as is the case with the sleeve 7 of the jack 1, it is not limited specifically to such a shape but may also be arc-shaped. The oval outside shape of the ring 30 allows for easy holding of the ring 30 at flat portions 37, shown in FIG. 7, with a hand and facilitates positioning of the plug 20 relative to the sleeve 7, the ring 30 is capable of being turned.

Turning back to FIG. 1, the terminals secured to the jack 1 and their electric connections will be described. In the rear end portion of the plug receiving hole 6 in the jack housing 2, contact housing grooves (not shown) are formed for housing the chip and ring terminals 4 and 5. In the top of the jack housing 2 at the rear of the sleeve 7, a window 15 is provided which communicates with the plug receiving hole 6. On either side of the jack housing 2, in a position that is a little rearward of the window 15, a concave portion 16 is formed. The concave portion 16 slidingly receives a side panel 3*a* of the sleeve terminal 3 lengthwise of the jack housing 2.

A lug 17 is provided on the concave portion 16. The lug 14 is provided in the approximate center of the concave portion 16 and protrudes outwardly from the surface of the concave portion 16. The lug 17 is for engagement with a hole 3*b* made in the side panel 3*a* of the sleeve terminal 3 to prevent the side panel 3*a* from detaching from or coming off the jack housing 2. The side panel 3*a* of the sleeve terminal 3 extends down from either side of a horizontal panel 3*f* and the side panel 3*a* has a leg 3*d* formed integrally therewith and to be soldered to an earth pattern (not shown) of a printed circuit board. The horizontal panel 3*f* has a contact portion 3*e* at a forward end thereof. The contact portion 3*e* is bent downwardly in the shape of a letter "U". The contact portion 3*e* makes elastic contact with the sleeve electrode 23 of the plug body 22.

The chip terminal 4 is an inverted L-shaped member, formed by punching, and has an upper horizontal mounting portion 4*b* and a downward leg portion 4*c*. The mounting portion 4*b* has an intermediate portion folded back to form a chip contact portion 4*a*. The chip contact portion 4*a* makes elastic contact with the chip electrode 24 of the plug body 22 and is electrically connected there through to the plug 20. On the other hand, the leg portion 4*c* is connected to a pattern of the circuit board placed under the jack 1. A lug 4*d* is formed on the upper edge of the mounting portion 4*b* for locking the chip terminal 4 in the contact housing groove (not shown) after the chip terminal 4 is inserted into the jack housing 2.

The ring terminal 5 is also an inverted L-shaped member formed by punching, as is the case with the chip terminal 4, and has a flat base portion 5*b* and a downward leg portion 5*c*, which is connected to a pattern of the printed circuit board. The base portion 5*b* has an acutely bent ring contact portion 5*a*, which makes elastic contact with the ring electrode 25 of the plug body 22. A lug 5*d* is for engagement with the contact housing groove (not shown) to lock the ring terminal 5 therein.

As will be seen from the above, the sleeve receiving hole 31 is placed in alignment with the sleeve 7 in accordance with its outside shape to establish connection between the jack 1 and the plug 20. Then, the sleeve 7 is inserted into the sleeve receiving hole 31, and the inner periphery 34 of the hole 31 is fitted into the grooves 12, after which the ring 30 is turned clockwise. By the clockwise turning of the ring 30, the inner periphery 34 of the sleeve receiving hole 31 slides into the sloped portions 12*a* of the grooves 12. When the ring 30 is further turned 90 degrees, the inner periphery 34 of the sleeve receiving hole 31 reaches the flat engaging portions 12*b* of the grooves 12 and the protrusions of the ring 30 is further turned 90 degrees, the inner periphery 34 of the sleeve receiving hole 31 reaches the flat engaging portions 12*b* of the grooves 12 and the protrusions of the ring 30 protrude from the recesses 14 made in the grooves 12, thereby arresting further turning of the ring 30 and establishing a connection between the jack 1 and plug 20. In this state, the terminals 3,4 and 5 of the jack 1 make contact with the corresponding electrodes 23, 24 and 25 of the plug 20, and the engagement of the inner periphery 34 of the sleeve receiving hole 31 with the grooves 12 prevents accidental disconnection of the terminals and the electrodes due to vibrations or shocks applied thereto and hence ensures reliable connections between the terminals and the electrodes. Thus, the plug-jack connecting structure of the present invention provides for a sure coupling between the jack 1 and the plug 20 without the need for forming complex screw threads. Hence, the plug-jack connecting structure of the present invention is simple in construction, easy to fabricate and allows for easy connection of the jack and the plug without the necessity of turning the ring 30.

When the jack 1 and the plug 20 are held together, the protrusions 35 of the ring 30 are engaged with the recesses 14 in the grooves 12, so that the ring 30 will not accidentally turn and hence will not come off of or detach from the sleeve 7. Additionally, since the grooves 12 and the inner periphery 34 of the sleeve receiving hole 31 make close contact with each other, the jack 1 and the plug 20 can stably be connected.

In the present invention, the outside shape of the sleeve 7 and the sleeve receiving hole 31 may be made in an elliptic, oblong, polygonal or similar noncircular shape as well as the above-described oval one. The recesses 14 and the protrusions 35 for engagement therewith need not always be provided. The width of the groove 12 and the thickness of the inner periphery 34 of the sleeve receiving hole 31 may also be suitably chosen.

According to the first aspect of the present invention, since the grooves 12 cut in the outer periphery of the sleeve 7 and the inner periphery 34 of the sleeve receiving hole 31 are brought into engagement by turning the ring 30, the plug 20 and jack 1 can easily be connected and, in addition, the engagement of the inner periphery 34 of the sleeve receiving hole 31 with the grooves 12 permits firm coupling of the plug 20 to the jack 1 and prevents accidental disconnection of plug 20 from the jack 1. This avoids the necessity of using complicated screwing and provides a connecting structure which will not allow the plug 20 to come off of or detach from the jack 1.

According to the second aspect of the present invention, the jack 1 and the plug 20 can be connected, without play therebetween, since the grooves 12 and the inner periphery 34 of the sleeve receiving hole 31 make close contact with each other.

According to the third aspect of the present invention, since the engagement of the protrusions 35 of the ring 30 with the recesses 14 in the grooves 12 arrests accidental turning of the ring 30, the connection between the jack 1 and the plug 20 is ensured.

It will be apparent that many modifications and variations may be effected without departing from the scope of the novel concepts of the present invention.

What is claimed is:

1. A plug-jack connecting structure for making connections between a plurality of terminals secured to a jack and a plurality of corresponding electrodes of a plug by inserting said plug into said jack, said plug-jack connecting structure, comprising:

a sleeve having a non-circular outside shape and formed as a unitary structure with said jack at one end thereof;

a ring having an inwardly protruded end wall at a leading end thereof, said inwardly protruded end wall forming a sleeve receiving hole being of a shape complementary to a shape of said sleeve, said ring being undetachably, rotatably mounted on said plug at one end thereof opposite said jack; and grooves cut into an outer periphery of said sleeve along a direction of rotation of said ring so that when said ring is rotated, said inwardly protruded end wall comes into engagement with said grooves to prevent disengagement of said ring and said sleeve from each other.

2. The plug-jack connecting structure of claim 1, wherein a width of each of said grooves and a thickness of said inwardly protruded end wall are substantially equal to each other.

3. The plug-jack connecting structure of claim 2, wherein recesses are formed in inner side walls of said grooves and protrusions are protrusively provided on said ring for engagement with said recesses at a rotational position where said inwardly protruded end wall and said grooves engage each other.

* * * * *